73-660
12/9/80 XR 4,238,789

United States Patent [19]
Wehde
[11] 4,238,789
[45] Dec. 9, 1980

[54] APPARATUS FOR MONITORING THE YARN PRODUCED BY AN OPEN-END SPINNING TURBINE

[75] Inventor: Heinz Wehde, Rothenberg, Fed. Rep. of Germany

[73] Assignee: TELDIX GmbH, Heidelberg, Fed. Rep. of Germany

[21] Appl. No.: 862,047

[22] Filed: Dec. 19, 1977

[30] Foreign Application Priority Data

Dec. 18, 1976 [DE] Fed. Rep. of Germany ..... 2657525

[51] Int. Cl.[2] ..... D01H 13/22; G01M 1/22; G08B 21/00

[52] U.S. Cl. ..... 340/677; 57/81; 73/160; 73/593; 73/660; 340/682

[58] Field of Search ..... 340/673, 677, 679, 682, 340/683, 665; 57/81, 100; 66/157, 158, 163; 242/36, 57; 73/160, 593, 660, DIG. 4; 308/1 A

[56] References Cited

U.S. PATENT DOCUMENTS

| | | | |
|---|---|---|---|
| 2,957,127 | 10/1960 | Wright, Jr. | 73/660 X |
| 3,604,958 | 9/1971 | Palini | 340/665 X |
| 3,678,493 | 7/1972 | Shuey | 340/682 X |
| 3,681,978 | 8/1972 | Mathias et al. | 73/660 |
| 3,972,171 | 8/1976 | Handschuch et al. | 57/100 X |
| 3,974,665 | 8/1976 | Rencin et al. | 340/677 X |
| 4,060,965 | 12/1977 | Schwartz | 340/677 X |
| 4,117,359 | 9/1978 | Wehde | 57/100 X |

*Primary Examiner*—John W. Caldwell, Sr.
*Assistant Examiner*—Joseph E. Nowicki
*Attorney, Agent, or Firm*—Spencer & Kaye

[57] ABSTRACT

In order to monitor irregularities in textile yarn being produced in an open-end spinning turbine of the type having an elastically mounted rotor, there is provided a sensor arranged to sense radial deflections experienced by the rotor or its bearing and associated with the occurrence of such irregularities.

12 Claims, 5 Drawing Figures

APPARATUS FOR MONITORING THE YARN PRODUCED BY AN OPEN-END SPINNING TURBINE

BACKGROUND OF THE INVENTION

The present invention relates to an apparatus for monitoring irregularities in a textile yarn being produced by an open-end spinning turbine, the apparatus being of the type which employs a measuring value sensor to detect the irregularities and an evaluation circuit which, upon the occurrence of irregularities, in particular a predetermined number of irregularities, per given time interval or during irregular time intervals, emits a signal to a display and/or to switch off the spinning turbine.

Such an apparatus is disclosed in German Offenlegungsschrift [Laid-Open Application] No. 2,509,259. That apparatus includes a measuring value sensor disposed in the yarn removal path to generate an analog signal which is representative of the thickness of the yarn. A pulse is generated each time this analog signal exceeds a threshold value, i.e. when the thickness of the yarn exceeds a selected value, and the resulting pulses are counted in a counter, the occurence of at least a given number of pulses within a given period of time causing a display or switch-off signal to be emitted.

Monitoring of the yarn being produced in an open-end spinning machine is recommended because irregularities, particularly thickness variations in the yarn may occur irregularly in cycles or even at regular intervals and thus would lead to undesirable moiré effect in fabrics produced from that yarn.

Such thicker or thinner portions are produced mainly as a result of deposits of dirt particles in the rotor of the spinning turbine.

SUMMARY OF THE INVENTION

It is therefore an object of the present invention to simplify the detection of irregularities at least in a certain type of open-end spinning turbine, which is the type whose rotor is supported by a bearing which is elastically mounted in a stationary support.

This and other objects are achieved, according to the present invention, by associating at least one sensor which responds deflections with the rotor and/or the bearing of such spinning turbine.

Such elastically or flexibly mounted rotors are disclosed, for example, in German Offenlegungsschriften Nos. 2,404,241 and 2,427,055, and their counterpart United States Application Ser. No. 695,551, filed by me on June 14th, 1976 now U.S. Pat. No. 4,117,359. The rotors of such turbines are elastically mounted so as to reduce the stresses imposed on the bearings by the rapidly rotating rotors.

The present invention is based on the realization that even small deposits of dirt in the rotor of an open-end spinning turbine will produce an imbalance. With an elastically mounted rotor, the latter rotates supercritically about its major axis of inertia. If the rotor possesses an imbalance, this axis of inertia no longer coincides with the rest position of the rotor axis. Rather, this axis moves on a conical or cylindrical path which is concentric with the rest position of the rotor axis. When projected onto a plane containing the rotor axis in its rest position, the movements of the axis and of the bearing have the form of oscillations which can be measured with known sensors.

The amplitude of these oscillations depends on the magnitude of the imbalance, while the frequency of these oscillations is equal to the rotation frequency of the rotor. These imbalances also occur if thicker or thinner regions exist in the rotor for other reasons.

For example, in a rotor having a diameter of about 50 mm and a weight of about 70 g, an imbalance of 1 mg may produce an oscillation amplitude of about $0.5\mu$, which can be sensed quite easily with known measuring means. The usual operating imbalances of such a rotor, however, are much smaller in comparison, so that it will be possible to differentiate between oscillations produced by larger local deposits and oscillations produced by the usual operating imbalances.

By assigning an amplitude limit value or threshold value, for the signals generated by the oscillations and processing those signal segments which exceed that value, it is possible to filter out the signals originating from the deposits. Another possibility is to compare successive segments of the imbalance signal and to conclude from the changes noted that there are irregularities.

As already indicated, the oscillation amplitude can be used as a measuring criterion. Another possibility is to sense the oscillation rate, i.e. the velocity of the oscillation, which is of course also dependent on the signal amplitude, in order to distinguish between the different causes of imbalance. Moreover, the pressure exerted on the elastic support for the rotor bearing can be sensed by means of a piezoelectric sensor to provide a measurement of the imbalance.

DESCRIPTION OF THE PREFERRED EMBODIMENTS

Figure 1:
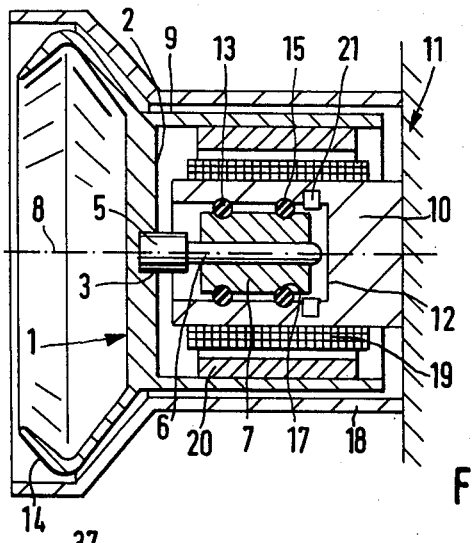
FIG. 1 is a cross-sectional, side view of a spinning turbine with an elastically supported bearing for the rotor, corresponding to an embodiment disclosed in my copending United States application, cited above, and equipped with a sensor according to the invention.

FIG. 1 shows an open-end spinning turbine equipped with its own drive system and an elastically mounted bearing for the rotor, which is exemplary of the type of spinning turbine in which the present invention can be used.

The turbine includes a rotor 1 provided with a cup-shaped or bell-shaped part 9 which has a bore 3 at the center of its base 2. In the bore 3 a pin 5 is positioned, and the free end 6 of the pin projects into a bearing bush 7. Free end 6 and bush 7 together constitute a journal bearing, the bush being the stationary part of the bearing and end 6 being the rotary part thereof. The center of gravity of the rotor is located at least approximately on its axis of symmetry 8, and in the region of the journal bearing, which includes the bearing bush 7 and the end 6. A part 10 of a stator 11 projects into the cup-shaped rotor part 9, and has a bore 12 to accommodate the bearing bush 7. The bearing bush 7 is elastically supported in the bore 12 by means of parts of elastic material which are constructed as O-rings 13. These O-rings lie in annular grooves 15 in the interior surface of the bore 12, as well as in annular grooves 17 in the outer surface of the bearing bush 7. Instead of O-rings, a spiral spring (not shown) can be used, one end of the spring lying preferably against the bore 12 and the other end lying against the bearing bush 7. The portion of pin 5, 6 projecting from base 2 is axially shorter than cup-shaped portion 9 so that the latter will provide protection for the pin when the rotor is removed from the stator.

An electric motor is provided for driving the rotor 1. To this end substantially radially magnetized permanent magnets 20 are positioned on the inner surface of the cup-shaped part 9 of rotor 1. The permanent magnets 20 have an alternating polarity in the peripheral direction and are fastened to the rotor as individual magnets.

Windings 19 are provided on the opposite face of the stator part 10 and are associated with the permanent magnets. A current is caused to flow through the windings so that the rotor is driven, for example, like a brushless direct current motor. The windings 19 are constructed without iron so as to prevent additional forces or moments from being generated which can act on the bearing and which would otherwise be present in an electric motor constructed in this way.

The front end of the rotor (to the left in FIG. 1) is constructed to have a funnel-like form 14. When using this device in spinning frames, or turbines, operating according to the open-end method, the material to be spun is introduced into the funnel-like front end of the rotor and drawn off in a known manner. If, for example, as a result of manufacturing tolerances or of the material located in the funnel 14, the center of gravity of the rotor is not located exactly on the axis of symmetry 8, the rotor can still rotate about its largest central principal axis of inertia adjacent axis 8 because of the floating bearing which is provided as above described, thereby preventing creation of additional bearing forces.

The importance of the construction of the drive motor as an iron-free electric motor is then enhanced in that it also ensures that no additional radial forces or moments are exerted on the bearing even by the drive itself, that is to say, even if the rotor does not rotate exactly about the axis 8. In order to reduce drive losses due to the air resistance, which occur particularly at high speed, the rotor is surrounded on its outside by a stationary housing 18. Stator 11 is further provided with a sensor 21 which senses the oscillations experienced by elastically mounted bearing 6, 7 in a plane through axis 8.

Figure 2:
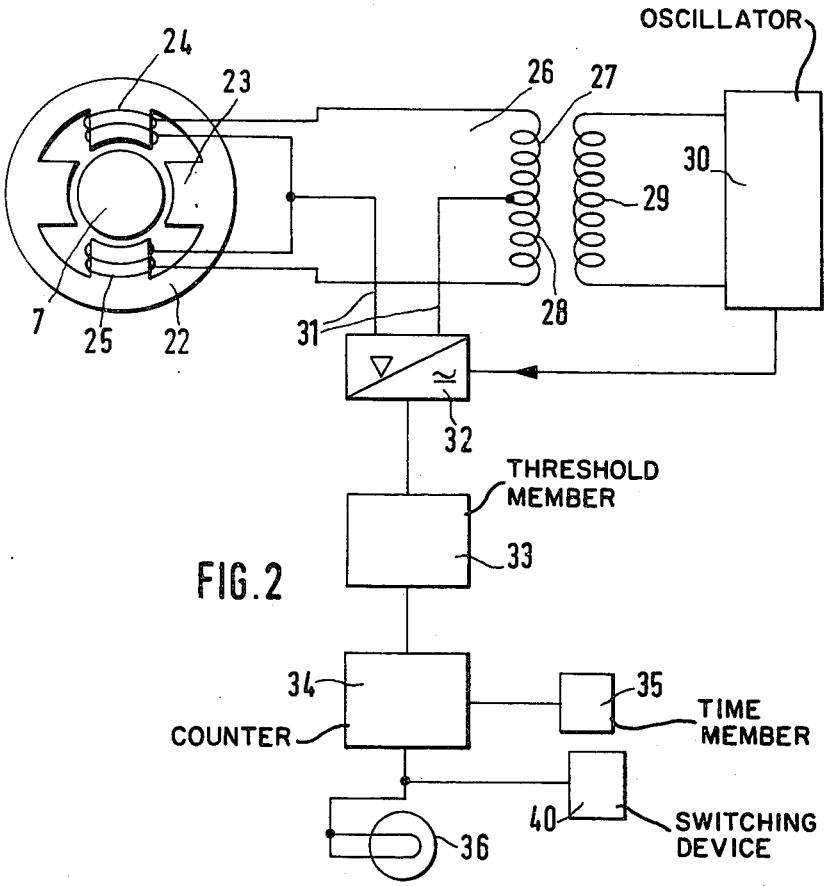
FIG. 2 is a partly pictorial and partly schematic illustration of a measuring arrangement according to the invention for measuring the oscillation amplitude of the rotor or of its bearing.

FIG. 2 shows an embodiment of a measuring system which includes such a sensor and produces a signal that is representative of the oscillation amplitudes of bearing bush 7. The sensor here includes an iron ring 22 having four poles 23, two windings 24 and 25 being disposed on respective ones of two oppositely disposed poles 23 and forming two branches of a high frequency bridge 26. The other two branches of this bridge are formed of two further windings 27 and 28 which are connected together in series and have their point of connection connected to a first lead 31. Windings 27 and 28 are inductively coupled with a primary winding 29 via which an operating signal at a carrier frequency of, for example, 100 kHz is coupled in from an oscillator 30. Windings 24 and 25 are connected together at one end to a second lead 31.

When the bearing bush 7, which is made at least in part of ferromagnetic material, oscillates in the plane defined by the common axis of the wound poles 23, there will be mutually oppositely directed changes in inductance in coils 24 and 25 and thus an amplitude modulation of the voltage between leads 31. By effecting a phase-sensitive rectification in member 32, there is obtained a voltage having a frequency which is proportional to the rate rotation of rotor 14 and an amplitude proportional to the degree of imbalance. From this alternating voltage, a threshold member 33 produces a pulse each time the amplitude of the voltage exceeds a certain value.

Each such pulse is delivered to a counter 34 to be counted. The duration of each counting operation is set by a time member 35 which returns the counter 34 to its starting condition after a set time interval. If during such a time interval, a given counting state is exceeded, the counter emits an output signal which energizes a warning lamp 36. The signal may also be supplied to a switching device 40 which then stops the spinning turbine.

Instead of the sensor shown in FIG. 2, a capacitive sensor of a known type may be used or, if a magnet is provided at the bearing, a magnetic field sensitive sensor, e.g. a Hall probe or a sensor which experiences a change in the premagnetization of the core of its coils, or another known displacement measuring sensor may be used.

Figure 3:
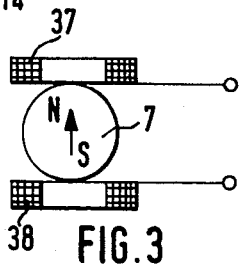
FIG. 3 is a simplified pictorial illustration of a measuring arrangement according to the invention for monitoring the rate of the oscillation.

In the embodiment shown in FIG. 3, the bearing bush 7 is provided with a transversely magnetized member, as indicated by North and South pole notations, so that pulses are induced in coils 37 and 38, by oscillations experienced by bush 7, with an amplitude which depends on the speed of the oscillating movement, i.e. the time rate of change of position of bush 7, and this also on the oscillation amplitude. These pulses can be evaluated in a manner similar to that described with reference to FIG. 2, i.e. they can be fed to a threshold value stage corresponding to 33 which emits pulses when a threshold value has been exceeded, which pulses are then added in a counter during given time periods, a warning signal being produced if a given number of pulses has been exceeded during such a period.

Figure 4:
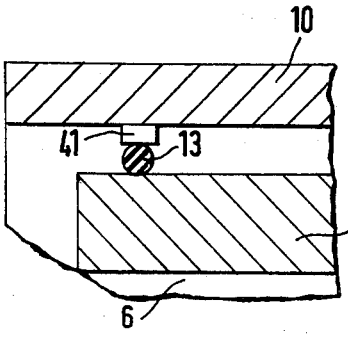
FIG. 4 is a cross-sectional detail view of a portion of the device of FIG. 1 provided with a measuring arrangement for measuring the pressure exerted on the elastic support of the rotor bearing.

FIG. 4 shows a small section of FIG. 1, in the area of one O-ring 13, where there is provided a sensor 41 which is interposed between ring 13 and the inner wall of stator part 10 and which senses the radial deflections of bush 7. Sensor 41 may be of a type which operates according to the piezoelectric principle, i.e. it can be capable of responding to pressure variations to which a crystal is subjected by deflections of bush 7 the crystal converting these changes in pressure into changes in voltage which are then evaluated. Sensor 41 is here disposed in the area of the elastic means, i.e. according to FIG. 1 at an O-ring 13, and could also be interposed between that ring and bush 7.

Since the rotor itself may possibly have a slight inherent, or residual, imbalance, which would make the detection of imbalances produced, for example, by soiling, more difficult, the effect of the inherent imbalance may be eliminated by electrical compensation means. For this purpose, there can be provided an alternating voltage which just compensates the signal produced by the imbalance sensor when the rotor is running without being supplied with fibers and is not soiled; i.e. an alternating voltage is produced at the rotor frequency and with the amplitude of the signal from the imbalance sensor, but in phase opposition thereto, and the two voltages are superposed. This compensation signal can be derived from the motor control electronic system, but in that case means are required to set the requisite phase and amplitude.

Figure 5:
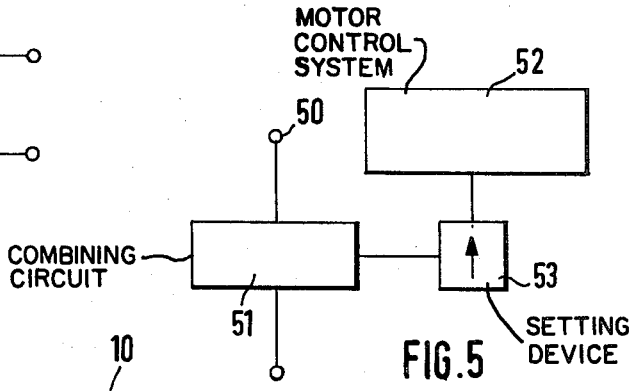
FIG. 5 is a schematic diagram of a circuit for providing compensation for the normal operating imbalance of the rotor.

Such an arrangement is shown in a general form in FIG. 5, as a circuit which can be connected, for example, between the output of rectifier 32 and the input of threshold value stage 33 of FIG. 2. The imbalance signal from rectifier 32 is introduced at terminal 50 and is superposed on the compensation voltage in a combining circuit 51 in order to effect compensation for the inherent imbalance of the rotor. The compensation voltage, at the frequency of the signal produced from the imbalance inherent to the rotor and at the same amplitude but in opposite phase thereto, is derived by obtaining a signal from the electronic control system 52 of the motor and by adjusting this signal in amplitude and phase by a setting means 53. The resulting signal is superposed in device 51 on the imbalance signal from rectifier 32. The voltage from means 53 is set when the rotor is clean and is running without being supplied with fibers. The output from device 51 is supplied via a terminal 54 to the input of threshold stage 33. As said, the motor is a brushless direct current motor. For commutating the direct current, there is needed a commutating voltage, the frequency of which is proportional to the rotation of the rotor. A signal derived of this voltage and having the frequency of the rotation is set in phase and amplitude in the setting device 53.

It will be understood that the above description of the present invention is susceptible to various modifications, changes and adaptations, and the same are intended to be comprehended within the meaning and range of equivalents of the appended claims.

What is claimed is:

1. In a system for monitoring irregularities in the textile yarn being produced by an open-end spinning turbine, the turbine including a rotor rotatably mounted in a bearing and means elastically supporting the bearing, the system including a measuring value sensor to detect such irregularities and an evaluation circuit connected to the sensor to produce a signal upon the occurrence of irregularities, the improvement wherein said sensor constitutes means associated with at least one of said rotor and bearing and responsive to radial deflections thereof for producing a deflection signal, and said evaluation circuit comprises electrical compensation means connected in said evaluation circuit to modify the signal produced by said sensor as a function of a inherent imbalance in said rotor in order to compensate for the influence on said sensor output of deflections due to such imbalance for producing a compensated signal indicative of said irregularities.

2. An arrangement as defined in claim 1 wherein said measuring value sensor is a displacement sensor which senses the magnitude of the deflections.

3. An arrangement as defined in claim 1 wherein said measuring value sensor senses the speed of the radial deflections.

4. An arrangement as defined in claim 1 wherein said evaluation circuit includes threshold means responsive to said compensated signal for causing the emission of a signal by said circuit to be only in response to deflections which exceed a given amplitude.

5. An arrangement as defined in claim 1 wherein said evaluation circuit comprises a counter responsive to said compensated signal for counting the number of deflections associated with irregularities occurring per unit time and producing the signal when the number of deflections per unit time exceeds a predetermined value.

6. An arrangement as defined in claim 1 wherein said sensor is a piezoelectric sensor disposed for sensing changes in the pressure exerted on said means elastically supporting the bearing due to such radial deflections.

7. An arrangement as defined in claim 1 wherein said compensating means produce an electrical signal at the same frequency and amplitude as the signal produced by such inherent imbalance, but in phase opposition thereto and superpose such electrical signal on the output from said sensor.

8. An arrangement as defined in claim 1 further comprising warning signal emitting means connected to be actuated by a signal produced by said evaluation circuit.

9. An arrangement as defined in claim 1 further comprising switch means connected to switch off the turbine in response to a signal produced by said evaluation circuit.

10. An arrangement as defined in claim 1 wherein said sensor is responsive to radial deflections experienced substantially equally by said rotor and said bearing.

11. A method for monitoring irregularities in the textile yarn being produced by an open-end spinning turbine including a rotor rotatably mounted in a bearing and means elastically supporting the bearing, said method comprising monitoring deposits of yarn irregularity producing dirt in the rotor by measuring radial deflections of at least one of the rotor and bearing due to such deposits by means of a measuring value sensor responsive to such deflections, and producing a signal upon the occurrence of such deflections by means of an evaluation circuit connected to the sensor.

12. A method as defined in claim 11 wherein said step of measuring radial deflections comprises compensating for influences on the measuring value sensor of deflections due to imbalance inherent in said rotor.

* * * * *